US006791448B2

(12) United States Patent
Kaltenborn et al.

(10) Patent No.: US 6,791,448 B2
(45) Date of Patent: Sep. 14, 2004

(54) FUSIBLE ELEMENT, METHOD FOR PRODUCTION THEREOF, SAFETY CIRCUIT AND FUSE

(75) Inventors: Uwe Kaltenborn, Baden-Dättwil (CH); Pal Kristian Skryten, Skien (NO)

(73) Assignee: ABB Research LTD, Zurich (CH)

( * ) Notice: Subject to any disclaimer, the term of this patent is extended or adjusted under 35 U.S.C. 154(b) by 19 days.

(21) Appl. No.: 10/275,095

(22) PCT Filed: Apr. 17, 2001

(86) PCT No.: PCT/CH01/00242

§ 371 (c)(1),
(2), (4) Date: Nov. 1, 2002

(87) PCT Pub. No.: WO01/86684

PCT Pub. Date: Nov. 15, 2001

(65) Prior Publication Data

US 2003/0098770 A1 May 29, 2003

(30) Foreign Application Priority Data

May 8, 2000 (DE) ..... 100 22 241

(51) Int. Cl.[7] ..... H01H 85/06; H01H 85/11

(52) U.S. Cl. ..... 337/160; 337/152; 337/159; 29/623

(58) Field of Search ..... 337/160, 159, 337/198, 152, 216, 266, 270; 29/623

(56) References Cited

U.S. PATENT DOCUMENTS

| | | | | |
|---|---|---|---|---|
| 3,705,373 A | | 12/1972 | Cameron | |
| 4,219,795 A | * | 8/1980 | Panaro et al. | 337/296 |
| 4,357,588 A | | 11/1982 | Leach et al. | |
| 4,635,023 A | * | 1/1987 | Oh | 337/163 |
| 4,654,620 A | | 3/1987 | Rooney et al. | |
| 4,944,084 A | * | 7/1990 | Horibe et al. | 29/623 |
| 5,528,213 A | * | 6/1996 | Kondo et al. | 337/160 |
| 5,546,066 A | * | 8/1996 | Kondo et al. | 337/163 |
| 5,714,923 A | | 2/1998 | Shea et al. | |
| 5,821,847 A | * | 10/1998 | Totsuka | 337/166 |
| 5,898,357 A | * | 4/1999 | Endo et al. | 337/159 |
| 5,900,798 A | * | 5/1999 | Hanazaki et al. | 337/160 |
| 6,075,434 A | * | 6/2000 | Rueckling | 337/160 |
| 6,163,244 A | * | 12/2000 | Endo et al. | 337/160 |
| 6,515,570 B2 | * | 2/2003 | Kaltenborn et al. | 337/290 |

FOREIGN PATENT DOCUMENTS

| | | |
|---|---|---|
| DE | 624633 | 1/1936 |
| DE | 668586 | 12/1938 |
| DE | 765700 | 2/1954 |
| DE | 948265 | 8/1956 |
| DE | 2248570 | 4/1973 |
| DE | 19846349 A1 | 8/1999 |
| DE | 19824851 A1 | 12/1999 |

(List continued on next page.)

*Primary Examiner*—Anatoly Vortman
(74) *Attorney, Agent, or Firm*—Burns, Doane, Swecker & Mathis, L.L.P.

(57) ABSTRACT

A fuse has a fuse element (6) with a fusible conductor (7) of a conductor material (8) such as Ag, Cu or Al and is provided with doping points (9) following one another at regular intervals. There, the conductor material (8) has a directly adjoining layer of a first compound (10) of the same with a doping material such as In or Ge. It forms mixed crystals which contain the conductor material (8) and the doping material in a fixed stoichiometric ratio, such as for example $Ag_2In$, and is separated from said conductor material by a stable phase boundary. The doping points (9) weaken the fusible conductor by lowering the melting point to below 250° C., so that arc formation rapidly occurs there when there are short-circuit currents, although its electrical resistance per unit of length is under some circumstances only a few percent greater than in the remaining region. The fusible conductor (7) bears a continuous layer of a burn-up material (12). It has an ignition temperature which is preferably lower than the melting point of the first compound (10).

28 Claims, 2 Drawing Sheets

FOREIGN PATENT DOCUMENTS

| | | |
|---|---|---|
| EP | 0016467 | 10/1980 |
| EP | 0128261 | 12/1984 |
| GB | 1283581 | 7/1972 |
| GB | 1369227 | 10/1974 |
| GB | 2120027 A | 11/1983 |
| GB | 2136644 A | 9/1984 |

* cited by examiner

FUSIBLE ELEMENT, METHOD FOR PRODUCTION THEREOF, SAFETY CIRCUIT AND FUSE

FIELD OF THE INVENTION

The invention relates to a fusible conductor for a fuse and also a fuse conductor and a fuse, as are used for interrupting excess currents such as occur for example as a consequence of short-circuits. Furthermore, it relates to a method of producing a fusible conductor and a fuse conductor.

BACKGROUND OF THE INVENTION

It has long been known (see for example U.S. Pat. No. 3,705,373) to apply doping material, for example tin or solder consisting of tin and lead, at a doping point, usually approximately in the middle of the fusible conductor of a fuse, and consequently to lower the melting point and at the same time increase the resistance there, so that, when there is a small excess current, the fusible conductor melts through first at the doping point. U.S. Pat. No. 4,357,588 discloses a further fusible conductor of this type, which has a plurality of doping points following one another in the longitudinal direction, which are respectively provided on an arm of the fusible conductor, which is divided there by a longitudinal slit and is reduced in its cross section. At the doping point, the tin or solder combines with the conductor material, for example silver or copper, to form an intermetallic compound, that is to say it is dissolved to a greater or lesser degree in the conductor material.

However, compounds of this type are subjected to aging processes, in particular at somewhat elevated temperatures, as occur in this application area, and these processes may also change the electrical properties of the fusible conductor in an undesired or not clearly foreseeable way. In particular, the doping material may spread out by diffusion in the conductor material, so that finally the local delimitation of the doping points is broken down to a greater or lesser degree.

To interrupt a large excess current, the fusible conductors described in the aforementioned documents have cross-sectional constrictions which are produced by round punched cutouts and follow one another at equal intervals and at which the fusible conductor then rapidly melts through. However, the punched cutouts form weaknesses and increase the resistance of the fusible conductor considerably, so that relatively high power losses occur there.

In the document DE-C-624 633 a method for producing a fusible conductor is disclosed that is utilized in a fusible fuse. This fusible conductor has at least one doping point at which a doping material different from the conductor material is applied to the conductor material. As a conductor material there is used silver and as doping material tin. The at least one doping point has somewhat been stabilized by a heat treatment. At the at least one doping point an alloy of conductor material and doping material has formed. This alloy does obviously not show any homogeneous material distribution.

SUMMARY OF THE INVENTION

The invention is based on the object of specifying a fusible conductor of the generic type in which the at least one doping point exhibits stable and controllable properties. This object is achieved by an electrically conductive fusible conductor material with at least one doping point, at which the conductor material is mixed with a doping material different from it. which forms with the conductor material a mixture with a melting point which is lower than that of the conductor material, the mixture with the conductor material comprising at least one constituent of the conductor material and at least one constituent of the doping material combined in fixed stoichiometric ratios.

It is also intended to specify a fuse conductor which contains at least one fusible conductor of this type and, when there is a small excess current, is interrupted as far as possible over the entire length, and also a fuse which comprises a fusible conductor of this type or a fuse conductor of this type. Finally, it is intended to specify a method of producing a fusible conductor according to the invention.

The fusible conductor according to the invention has at least one doping point which is largely stable at the temperatures occurring. In particular, it remains localized. Its electrical properties and its melting point are not subject to any major changes or any major random fluctuations.

It may also have many doping points following one another at regular intervals, at which it melts through very rapidly when there is a large excess current, so that a high voltage, corresponding to the sum of all the arc voltages, builds up. In this respect, the doping points take the place of the cross-sectional constrictions of known fusible conductors, without the resistance being increased to the same extent however. The power loss is therefore much smaller.

The fuse conductor according to the invention is also provided with a burn-up element, which ignites when an ignition temperature, preferably lying just below the melting point of the doping point, is reached and burns while releasing heat. As a result, even when there are relatively small excess currents, an interruption of the fuse conductor over substantially the entire length is achieved and the excess current is rapidly interrupted. The fuse according to the invention has the benefits obtained by virtue of the properties of the fusible conductor according to the invention or the fuse conductor according to the invention.

BRIEF DESCRIPTION OF THE DRAWINGS

The invention is explained in more detail below on the basis of figures, which merely represent exemplary embodiments and in which.

DETAILED DESCRIPTION OF THE INVENTION

Figure 1B:
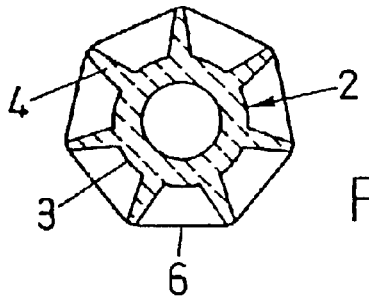
FIG. 1*b* shows a cross section along B—B in FIG. 1*a,*
Figure 1A:
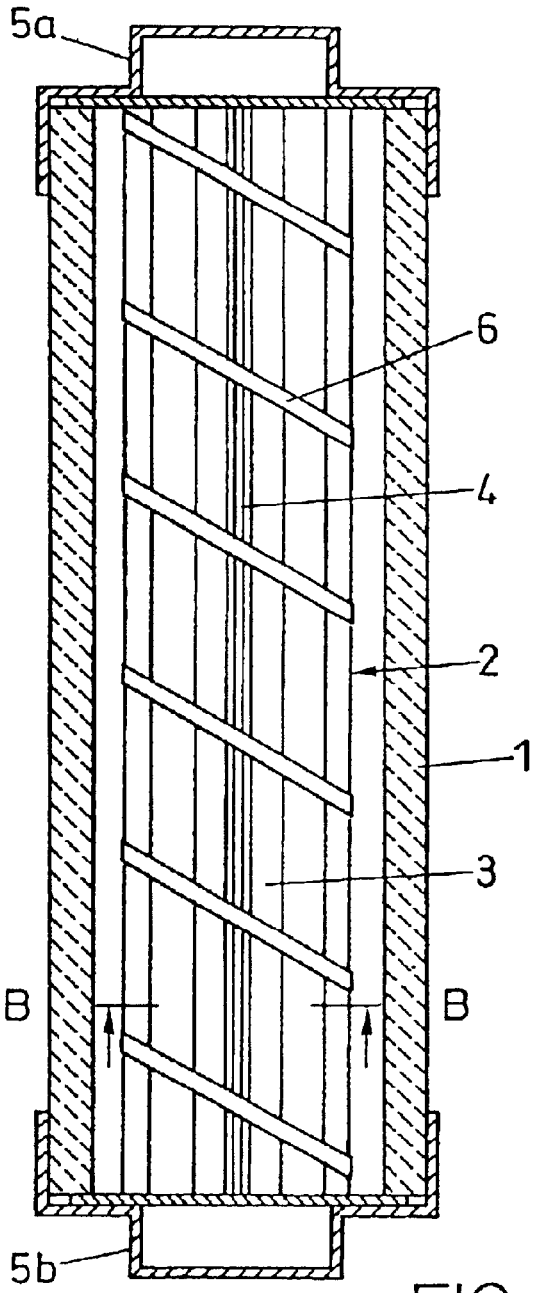
FIG. 1*a* shows a longitudinal section through a fuse according to the invention as provided by a first embodiment.

The fuse according to the invention has (FIGS. 1*a,b*) in a cylindrical housing 1, which may for example consist of ceramic, a supporting body 2, which is arranged in the axis, likewise consists of ceramic or else of plastic or a composite material, or otherwise a suitable electrically insulating material, and has a cylindrical or tubular basic body 3 with radially protruding ribs 4. Arranged at the ends of the housing 1 lying opposite one another are a first electrical terminal and a second electrical terminal, which are formed as metal caps 5*a,b*. The caps 5*a,b* are connected in an electrically conducting manner by fuse conductors 6 wound helically around the supporting body 2—there may also be a plurality of fuse conductors connected in parallel. The housing is filled with a quenching medium, such as quartz sand, for example.

Figure 2A:
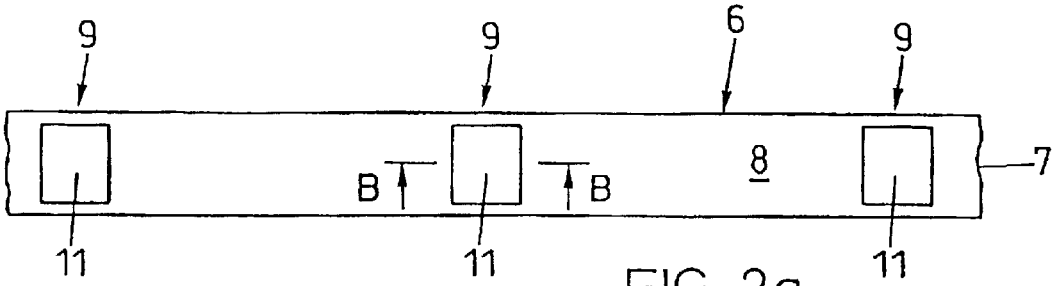
FIG. 2*a* shows a plan view of a fusible conductor or fuse conductor according to the invention as provided by a first embodiment.

As provided by a first embodiment (FIGS. 2*a,b*) of the fuse conductor 6, it has a fusible conductor 7 as provided by a first embodiment, the base of which is a strip of a suitable fusible electrically conducting conductor material 8, preferably silver or a silver alloy or else copper or aluminum. The strip has a width of between 1 mm and 2.5 mm; its thickness lies between 0.05 mm and 0.15 mm. The fusible conductor 7 has at regular intervals of between 5 mm and 20 mm doping points 9, at which, on a surface, for example a rectangular surface, of a width which is between 10% and 100% of the width of the fusible conductor 7, the layer of the conductor material 8 is weakened, but to ensure good mechanical strength is continuous, while on the same there lies a layer which consists of a first compound 10 of the conductor material 8 or at least one constituent of the same and a doping material or one constituent of the same.

The first compound 10 is a solid chemical compound which contains the at least one constituent of the conductor material and the at least one constituent of the doping material in fixed stoichiometric ratios. The first compound 10 is generally crystalline and consequently forms mixed crystals from said constituents. The substantially unmixed conductor material 8 and the first compound 10 therefore abut each other at a fixed phase boundary, the surface tension of which almost completely prevents diffusion of doping material into the conductor material at the temperatures of below 150° C. usually occurring during operation.

It is also possible for a plurality of compounds of this type to occur between the conductor material and the doping material, for example a second compound 11, which however generally does not directly adjoin the conductor material 8 but merely the first compound 10. Apart from the doping points 9, where it is enlarged by the doping material, the cross section of the fusible conductor 7 is in each case constant over its length. The melting point of the first compound 10 should be quite low, in particular not greater than 250° C., and its electrical conductivity should preferably be somewhat less than that of the conductor material. Altogether, however, the resistance per unit of length at the doping points should generally be greater than outside the same by at most a factor of 1.8, preferably 1.3.

Figure 3A:
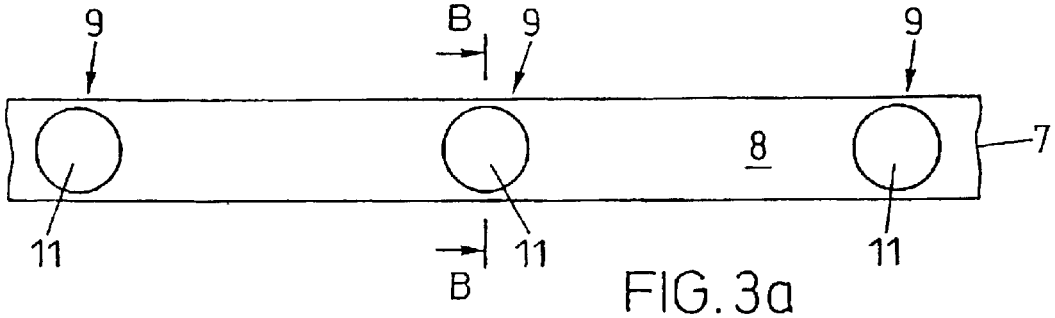
FIG. 3*a* shows a plan view of a fusible conductor or fuse conductor according to the invention as provided by a second embodiment.
Figure 3B:
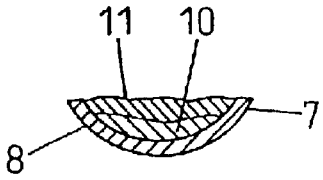
FIG. 3*b* shows a cross section along B—B in FIG. 3*a*.

As provided by a second embodiment of the fusible conductor 7 (FIGS. 3*a,b*), the strip has at the doping points 9 spherical cap-shaped indentations, produced by corresponding deformations of the conductor material 8, which form dish-like depressions, in which two layers which in turn consist of a first compound 10 and a second compound 11 in each case lie one on top of the other.

The combination of silver as the conductor material and indium as the doping material has proven to be particularly successful. In this case, $Ag_2In$ is formed as the first compound 10, which directly abuts the conductor material 7 and is adjoined by $AgIn_2$ as the second compound 11. The melting point of $Ag_2In$ lies between 187° C. and 204° C., depending on the structure of the mixed crystal, that of $AgIn_2$ lies at 166° C. There may of course also adjoin a further layer, which consists either exclusively of the doping material or of other compounds of the same, for example an oxide. Other possible conductor materials are alloys of Ag and also Cu, Al or alloys thereof. Apart from In, Ge also comes into consideration in particular as a doping material.

In the case of a fusible conductor as provided by the first embodiment, which consisted of silver as the conductor material and indium as the doping material, the melting temperature at the doping points was approximately 170° C. and the increase in the resistance per unit of length was on average around 5% and well below 15%. The standard deviation both for the melting temperature of the doping points and for the resistance per unit of length was significantly lower than when using Ag and Sn, the material of which diffuses into the Ag strip and forms with it an intermetallic phase of variable composition.

The preparation of the fusible conductor 7 as provided by the first embodiment in the preferred composition is performed by rectangular In platelets with a mass of, for example, 5 mg being placed at regular intervals onto an Ag strip of constant rectangular cross section and being pressed with the strip. Subsequently, the strip is introduced into an oven and heated to 400° C. in a reduced-oxygen or oxygen-free inert gas atmosphere—for example nitrogen or a noble gas such as argon or a mixture of such gases—with a temperature gradient of, for example, 500° C./h and is sintered at this temperature during 3 h. Subsequently, it is cooled in turn with a temperature gradient of 500° C./h. The sintering produces the configuration described above of the doping points, in which a proportion of the cross section which lies between 10% and 100% is formed by $Ag_2In$ and $AgIn_2$. Sintering temperatures and times can of course be chosen differently and adapted to the other conditions. Temperatures between 350° C. and 960° C., and in particular between 400° C. and 600° C., and times between 0.1 h and 10 h, and in particular 2 h and 8 h, have proven to be successful.

In the case of the fusible conductor as provided by the second embodiment, the dish-like depressions are impressed into the strip. In powder is converted into a slurry in a suitable carrier liquid, protecting the indium from oxidation, for example alcohol or ethylene glycol dimethyl ether, and in this form is poured into the depressions. In the subsequent sintering, proceeding as above, the carrier liquid evaporates.

Figure 2B:
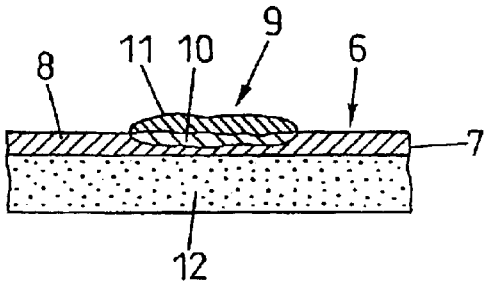
FIG. 2*b* shows a section along B—B in FIG. 2*a* through the fusible conductor as provided by the first embodiment.

The fuse conductor has a fusible conductor or else a plurality of fusible conductors disposed in parallel and possibly transversely connected at individual points. In addition, it comprises a burn-up element, which is preferably in contact with the fusible conductor or the fusible conductors over the entire length, at least at certain points. The burn-up element preferably consists of a burn-up material 12 (FIG. 2*b*), which in each case forms a continuous layer on the fusible conductor 7. The burn-up material 12 contains a combustible material and an oxidant, which on reaching an ignition temperature, which is preferably not higher than the melting temperature of the doping points 9, react with each other, thereby releasing a relatively great amount of heat.

Proven to be particularly successful as the combustible material are guanidines and guanidine derivatives such as diguanidine-5,5'-azo-tetrazolate (GZT), guanidine nitrate and guanidine acetate, mixtures of which can also be used. To increase the release of heat, an additive, which consists of at least a metal such as Mg, Al, Zr, Hf, Th, may also be added. Suitable as the oxidant are oxygen-rich compounds, in particular nitrates, chlorates, perchlorates and permanganates such as $KNO_3$, $NaNO_3$, $NH_4NO_3$, $KClO_4$, $NaClO_4$, $NaClO_4$, $KMnO_4$. If an additive is added to the combustible material, it is favourable to add to the oxidant a metal oxide which enters into a thermal reaction with at least one of the metals contained therein, for example $Fe_2O_3$. The burn-up material contains a hyperstoichiometric amount of oxidant, the proportion of which is generally hyperstoichiometric by at least a factor of 1.1, but preferably in a higher ratio, for example between 10:1 and 15:1. This leads to complete oxidation of the combustible material in a very rapidly occurring reaction.

By selecting and metering the oxidant in such a way that it releases an adequate amount of oxygen at a specific temperature, the ignition temperature of the burn-up material can be set with relatively great accuracy—generally to within ±10° C. In this case, values between 180° C. and 260° C. are preferred, preferably no more than 240° C. The amount of heat released is at least 200 J/g, preferably at least 300 J/g. Any metals contained in the combustible material are likewise brought to the ignition temperature by the previously commencing combustion of the organic fraction of the combustible material, and then make a significant contribution to the release of heat. Temperatures of 1700° C. and more are reached.

The following burn-up materials were investigated for example (the proportions are specified in % by mass):

1: 60% GZT, 40% $KMnO_4$

2: 40% GZT, 6% Mg, 54% $KMnO_4$

3: 30% GZT, 3.5% guanidine nitrate, 66.5% $KMnO_4$

4: 7.1% guanidine acetate, 92.9% $KMnO_4$

5: 33.3% guanidine nitrate, 11.1% Mg, 55.6% $KMnO_4$

6: 27.5% guanidine nitrate, 9.2% Mg, 16.7% PSA, 46.7% $KMnO_4$

7: 27.5% guanidine nitrate, 16.7% guanidine acetate, 9.2% Mg, 46.7% $KMnO_4$

8: 26.8% GZT, 13.4% guanidine acetate, 59.8% KMnO4.

The following values were determined for the ignition temperature and the heat release:

| Burn-up material | Ignition temperature [° C.] | Heat release [J/g] |
|---|---|---|
| 1 | 255 | 330 |
| 2 | 258 | 580 |
| 3 | 177 | 862 |
| 4 | 208 | 402 |
| 5 | 236 | 714 |
| 6 | 160 | 294 |
| 7 | 205 | 862 |
| 8 | 233 | 760 |

To produce favourable mechanical properties, the burn-up material may also contain a binder which, for example, makes the burn-up material spreadable or extrudable. Suitable here in particular is paraffin or beeswax, polyester or polyethylene. The binder is heated to the extent that it becomes kneadable and is then mixed with the combustible material and the oxidant by means of a kneader. In addition, binders known for use in pyrotechnics, for example polyethylenes, polyamides, polyimides, epoxy resins or inorganic substances such as silica gel or sodium silicate, may also be used as the binder. In particular in this case, granulate material may also be produced from the combustible material and the oxidant and be mixed with the binder. The mixture may be applied to the strip-shaped fusible conductor 7 over its entire length, for example by extrusion, so that the burn-up material 12 is in close mechanical and thermal contact with the same over its entire length. For example, it may be applied (FIG. 2*b*) to one of the surfaces of the fusible conductor 7, so that it completely covers the same, or layers may be applied to both surfaces of the fusible conductor 7.

Another possibility is the addition of elastomers crosslinking at temperatures above room temperature, for example between 40° C. and 130° C., for example silicone, or else materials shrinking greatly when heated to such temperatures, in particular polymers such as polyethylene or polypropylene, as binders, which are likewise mixed with the combustible material and the oxidant. The burn-up material 12 may then be brought into the form of a heat shrinkable tubing, which is pulled over the fusible conductor 7 andis crosslinked or shrunken, respectively.

If a great excess current occurs, corresponding to at least five times the nominal current and reaching the interrupting current at the given voltage according to IEC 282-1—such excess currents are triggered in particular by short-circuits—, the at least one fusible conductor 6 melts through very rapidly at the doping points 9, so that a series of relatively short arcs are produced. The addition of the base or nadir voltages of the many serial arcs has the effect that the voltage of the fuse is driven above the system voltage and the current is interrupted. The doping points 9 in this case play the role of the cross-sectional constrictions of known fusible conductors produced by punched cutouts or the like. However, the melting-through is mainly induced by lowering the melting point and not, as in the case of the constrictions, exclusively by increasing the resistance, so that the fusible conductor according to the invention causes significantly smaller power losses during normal operation.

On the other hand, when there is a small excess current, usually from approximately 1.1 times the nominal current—although the thermal conditions also have to be taken into account—, the at least one fusible conductor 7 heats up at the doping points 9 relatively rapidly to the ignition temperature of the burn-up material 12, which triggers a release of oxygen there by the oxidant sufficient for the combustion to be initiated. The local release of heat caused as a result then leads very rapidly to the ignition of the entire burn-up element, or if appropriate the plurality of burn-up elements. As a result, the fusible conductor is orthe fusible conductors are firstly melted very rapidly at the further doping points 9, where the melting temperature has almost been reached and the heat of fusion still required for melting is correspondingly low, which in turn leads to the formation of a series of relatively short arcs. If this does not lead immediately to interruption of the current, the fusible conductor is then melted over the entire length by the burn-up, so that a long arc is formed. After the burn-up of the burn-up material, the same releases considerable heat to the surrounding quenching medium. As a result, the plasma cools down and the resistance of the arc increases, until its voltage reaches the system voltage and the arc is extinguished.

The burn-up element is an optional element which is not necessary in every case. The electrical terminals of the fuse may also be connected merely by one fusible conductor or a plurality of parallel fusible conductors. It is ensured, however, that the fuse reliably responds even when there are small excess currents, and consequently represents a versatile multi-range fuse.

LIST OF REFERENCE SYMBOLS

1 housing
2 supporting body
3 basic body
4 rib
5*a,b* cap
6 fuse conductor
7 fusible conductor
8 conductor material
9 doping point
10 first compound
11 second compound
12 burn-up material

What is claimed is:

1. A fusible conductor for a fuse, with a strip which substantially consists of an electrically conductive fusible conductor material and has at least one doping point, at which the conductor material is mixed with a doping material different from it, which forms with the conductor material a mixture with a melting point which is lower than that of the conductor material, wherein the mixture with the conductor material comprises at least one compound in which at least one constituent of the conductor material and at least one constituent of the doping material are combined in fixed stoichiometric ratios, wherein a crosssection of the fusible conductor is not reduced at the at least one doping point and outside the at least one doping point the cross-section remains substantially constant.

2. The fusible conductor as claimed in claim 1, wherein the conductor material is separated from the one compound by a phase boundary, at which the same directly abut each other.

3. The fusible conductor as claimed in claim 1, wherein the one compound comprises mixed crystals containing in each case at least one constituent of the conductor material and at least one constituent of the doping material.

4. The fusible conductor as claimed in claim 1, wherein the melting point of the one compound does not lie above 250° C.

5. The fusible conductor as claimed in claim 1, wherein the conductor material substantially comprises at least one of the following constituents: Ag, Cu, Al.

6. The fusible conductor as claimed in claim 1, wherein the doping material substantially comprises at least one of the following constituents: In, Ge.

7. The fusible conductor as claimed in claim 1, wherein, also at the at least one doping point, part of its cross section is formed by unmixed conductor material.

8. The fusible conductor as claimed in claim 1, wherein it has a plurality of doping points, which follow one another, preferably at equal intervals, in the longitudinal direction.

9. The fusible conductor as claimed in claim 1, wherein its resistance per unit of length at the doping points is greater than outside the same by at most a factor of 1.8, preferably by at most a factor of 1.3.

10. A fuse conductor with at least one fusible conductor as claimed in claim 1, wherein it comprises an ignitable burn-up element, with which the at least one fusible conductor is in contact over its entire length, at least at certain points, and which consists of a burn-up material which contains a combustible material and an oxidant, which react with each other, releasing heat, when an ignition temperature is reached.

11. The fuse conductor as claimed in claim 10, wherein the at least one fusible conductor is in contact with the burn-up material continuously over its entire length.

12. The fuse conductor as claimed in claim 11, wherein the burn-up material forms a continuous layer on the fusible conductor.

13. The fuse conductor as claimed in claim 10, wherein the ignition temperature of the burn-up material is not higher than the melting point of the first compound.

14. The fuse conductor as claimed in claim 10, wherein the heat released by the burn-up material is at least sufficient to melt at least the parts of the at least one fusible conductor that are in contact with the burn-up element.

15. The fuse conductor as claimed in claim 10, wherein the combustible material contains a guanidine or guanidine derivative, in particular is substantially composed of a least one of the following substances: guanidine, GZT, guanidine acetate, guanidine nitrate.

16. The fuse conductor as claimed in claim 10, wherein the oxidant is substantially composed of at least one substance from one of the following substance groups: nitrates, chlorates, perchlorates, permanganates.

17. The fuse conductor as claimed in claim 10, wherein the quantity ratio between oxidant and combustible material is hyperstoichiometric by a factor of at least 1.1, preferably at least 10.

18. The fuse conductor as claimed in claim 10, wherein the burn-up material contains a binder, such as paraffin for example, or a thermoplastic, preferably polyethylene, or an elastomer, preferably silicone, or an elastically modified thermosetting material.

19. A fuse with a first electrical terminal and a second electrical terminal and also with at least one fusible conductor as claimed in claim 1, which connects the first electrical terminal to the second electrical terminal.

20. A fuse with a first electrical terminal an second electrical terminal and also with at least one fuse conductor as claimed in claim 10, which connects the first electrical terminal to the second electrical terminal.

21. A method for producing a fusible conductor as claimed in claim 1, in which at least one doping material is applied to a strip of conductor material, wherein the strip is subsequently sintered.

22. The method as claimed in claim 21, wherein the sintering is performed at a temperature which lies between 350° C. and 960° C., preferably between 400° C. and 600° C.

23. The method as claimed in claim 21, wherein the sintering lasts between 0.1 h and 10 h, preferably between 2 h and 8 h.

24. The method as claimed in claim 21, wherein the sintering takes place in an inert gas atmosphere.

25. The method as claimed in claim 24, wherein the inert gas atmosphere substantially comprises nitrogen, preferably with a noble gas mixed in, for example argon.

26. The method as claimed in claim 22, wherein the doping material is applied to the strip as platelets.

27. The method as claimed in claim 26, wherein the platelet is pressed with the strip.

28. The method as claimed in claim 21, wherein a depression is made in the strip and the doping material is introduced into the depression in the form of a powder converted into a slurry in a carrier liquid.

* * * * *